US008460120B1

(12) United States Patent
Azimi

(10) Patent No.: US 8,460,120 B1
(45) Date of Patent: Jun. 11, 2013

(54) METHOD FOR AUTO-ALIGNING GOLF CLUB HEAD

(71) Applicant: Saeed Azimi, Los Gatos, CA (US)

(72) Inventor: Saeed Azimi, Los Gatos, CA (US)

( * ) Notice: Subject to any disclaimer, the term of this patent is extended or adjusted under 35 U.S.C. 154(b) by 0 days.

(21) Appl. No.: 13/647,590

(22) Filed: Oct. 9, 2012

(51) Int. Cl.
*A63B 69/36* (2006.01)

(52) U.S. Cl.
USPC ..... 473/223; 473/245

(58) Field of Classification Search
USPC ..... 473/219, 223, 324–350
See application file for complete search history.

(56) References Cited

U.S. PATENT DOCUMENTS

| | | | | |
|---|---|---|---|---|
| 3,840,231 | A * | 10/1974 | Moore | 473/245 |
| 5,385,346 | A * | 1/1995 | Carroll et al. | 473/247 |
| 6,506,126 | B1 * | 1/2003 | Goodman | 473/245 |
| 7,993,211 | B2 * | 8/2011 | Bardha | 473/251 |
| 2008/0125236 | A1 * | 5/2008 | Kelly | 473/223 |

* cited by examiner

*Primary Examiner* — Nini Legesse
(74) *Attorney, Agent, or Firm* — Schneck & Schneck; David M. Schneck

(57) ABSTRACT

A golf club that can automatically align the club head with intended path of ball direction. The golf club encompasses a movable club head, electronics, a power source and motor driver for adjusting golf club head position at time of impact with a golf ball. The golf club can also serve as teaching aid for tracking a golfer swing path and errors in golf club path.

7 Claims, 4 Drawing Sheets

METHOD FOR AUTO-ALIGNING GOLF CLUB HEAD

TECHNICAL FIELD

This invention relates to the field of golf club equipment and more specifically, to a golf club having a feature to aid in club head alignment capability, improving golf ball movement on a desired path.

BACKGROUND

Golf is a complicated sport requiring precision and timing of various muscles to execute a desired swing. Even for top-professional golfers, who have had many hours of intense training, cannot achieve a perfect swing on consistent basis. A perfect swing would ensure golf club head is square with the golf ball and aligned on a path of the desired club swing. Putting, which typically makes up nearly 50 percent of a golfer's score and is a relatively slow motion, requires only minimal upper body motion. Developing and improving a putter swing is difficult. Proper use of a golf driver requires both precision and fast moving lower body and upper body movements that must be precisely timed relative to each other. In the example of golf putting, to achieve a successful outcome the golfer must align the putter such that the putter face is aligned with intended line of ball direction. This will help ensure that the putter head stays square at impact. This is called setup alignment. Next, the golfer must control critical body muscles such that no twisting or pull or push of club head occurs at impact of golf club head with golf ball (skidding or backspin). Also golfer must ensure that club head vertical plane is not shifted low or high, right or left. All these actions reduce or increase ball speed, may change ball trajectory direction and have an impact on the distance the ball will travel.

The golf industry has produced a number of golf putter or golf club systems intended to counter the effects of club/ball misalignment, so the golf game is more enjoyable for average recreational golfer. These systems are divided into two groups; (i) systems that improve the golf club designs through use of weight balancing or other means to control club head moments of inertia, material selection, alignment markers, club head, shaft or grip designs. All these systems are intended to reduce and counter the effects of golfer poor performance; and (ii) training systems solely intended to provide feedback mechanism for golfer as an aid to better correct for common problems: for example to teach proper swing or track progress of training over time. Some of these systems try to teach what industry refers to as "Muscle Memory", or ability of golfer to learn, through repeated movement, what it feels like when correct swing is executed. Even if the golf ball behaves in a desired manner, this does not always mean a correct swing was executed. As an example, a golf putt swing that opens the club face with outside-in path might produce a golf ball moving in straight path (two mistake make a right). Muscle memory training seeks to make the proper movement more automatic.

An improved golf club is desired. Such an integrated system would make the game of golf enjoyable by building confidence through eliminating many of common club head alignments problems so golfer can focus on smaller set of parameters to master while at same time providing training vehicle to learn gradually and improving performance.

SUMMARY OF THE INVENTION

The present invention includes a golf club comprising a club shaft having an upper grip end and a lower club head mount end and a club head mounted on the lower club head mount end. The club head includes a club face, at least one motor mechanically linked to the club face and configured to allow a pivotable positioning of the club face, a controller linked to the at least one motor and configured to actuate the at least one motor during club head movement to alter the position of said club face; and a battery mount joined to the controller and the at least one motor such that when a battery is inserted into said battery mount power may be provided to said controller and said at least one motor. The at least one motor may include more than one motor. The use of two motors allows the club face to be adjusted along to axes, for example to allow for horizontal and vertical position. The club head may also include a position sensor in the club head. The position sensor may generate a data stream that is stored in an onboard memory or wirelessly exported. The position sensor sends data to the controller for control of the club face.

The golf club of claim 1 may also include a grip pressure sensor positioned at said upper grip end of said club shaft, the pressure grip sensor electronically linked to said controller. The golf club of claim 1 may also include a visible indicator on the club head and configured to be controlled by said controller to provide visible indication of a controller state.

DETAILED DESCRIPTION

The following description provides detailed examples of envisioned embodiments of the present invention, it should be noted that these details are intended to be exemplary and in no way limit the scope of the invention.

Figure 1:
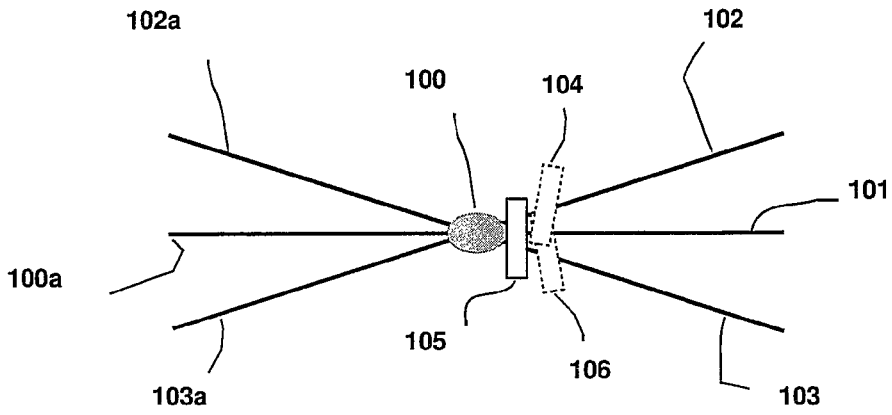
FIG. 1 is a top view of golf club, golf ball and club and ball paths.

With respect to FIG. 1, a golf ball 100 positioned at proper setup normally at equal distances from the golfer's two feet (or slightly forward for longer golf clubs). As the golfer swing the golf club, the golf club head can travel in path represented by 101 which is desired path of the golf club. Alternatively the head could travel in an inside-out direction as represented by 103 or outside-in direction as represented by 102. Furthermore, the golf club head itself can make contact with golf ball 100 at square position 105 or open face 104 or closed face 106. Depending on combination of club swing path and club head at contact and follow through defines the path that golf ball 100 will travel. A perfect golf swing will produce a club headsquare to the ball as seen in square position 105 and club path 101. Other combinations are not desirable and produce incorrect golf ball 100 path. These are referred as imperfect swings. As an example, a club swing path 102 with open face club head 104 can produce a golf ball 100 traveling to right of target along path 102*a*, called a slice. A moderate slice is called a fade in which club head is square 105 where golf ball first travels to left of target and then returns to target. Depending on power of club swing, angle of club head, and club path will determine the degree of slice, or fade. In another example, a club swing path 103 with closed face club head 106 can produce a golf ball 100 traveling to left of target along path 103*a*, called a hook. A moderate hook is called a draw in which club head is square 105 where golf ball first travels to right of target and then returns to target. Depending on power of club swing, angle of club head, and club path will determine the degree of hook, or draw. There are also other combinations that are called Push or Push Slice, Pull or Pull Hook that caused by various combination of club path and club head at impact with golf ball.

All such combination of imperfect swings are caused by complex movement of body, alignment errors at setup time, timing of various muscles, poor posture and/or muscle memory execution. Mastering all parameters required to execute a perfect swing is ever elusive target of every golfer, requiring hours of intense training. This reason explains why most recreational golfers and professionals fail to perfect their games Furthermore, at times it is desirable to actually create a slice or hook or other combination of defined golf ball trajectories. Many professional or experienced golfers use such combination to shape the flight of the ball path for optimum performance, avoid obstacles (such as tall tree), or adjust for winds. Again these combinations are difficult for the average recreation golfer.

In golf putting, where the goal is to roll the ball over carpet-like grass to a destination hole presents similar challenges, although not as challenging parameters as driving the golf ball for a long distance. However, technique is still similar with golfer first position to stand aligned and parallel to the path desired direction of the golf ball while aiming for the hole. Similar to the discussion above, if the club head is not square and/or the club head is not traveling a straight path then ball can roll to right or left of target path. In case of putting, those errors are often referred to as push or pull indicating right or left of target roll of golf club respectively. It is also critical that golf putter head contact the golf ball vertically square at middle of club head (called the sweet spot) to ensure the golf ball 100 rolls around its axis without causing spin or skidding. Putting technique requires that golf swing be isolated to upper torso movement with steady triangular hand position throughout the swing. Deviation will cause golf ball 100 to move away from target path. Unlike golf club driver swing, a golf putter swing is always intended for golf ball to follow the straight path on designated direction. Draw or fade is not desirable unless caused by contour of putting ground and location of ball from the target hole. Normally, a golfer adjusts for such contours by changing the setup of desired path and speed of swing.

As explained, the game of golf is very complex to perfect, as there are many factors influencing trajectory of golf club path from desired path. What is needed is ability of golf club to anticipate and calculate errors generated by a golfer and adjust for variation in golf club swing and golf club head by changing golf club head sufficiently and at the right time to counter the produced errors. For example, if club swing path is 102, then opening the club head to position 104 will produce a golf ball 100 traveling in designated desired path 101. Although, this swing would still impart spin on the golf ball resulting in fade, the result is still far more desirable than if no adjustment were made to the golf head. Furthermore, in case of putting, most common errors can be removed by dynamic ability of golf head to change the angle of the club face. This is especially true if putter head can be adjusted both horizontally and vertically.

Figure 2:
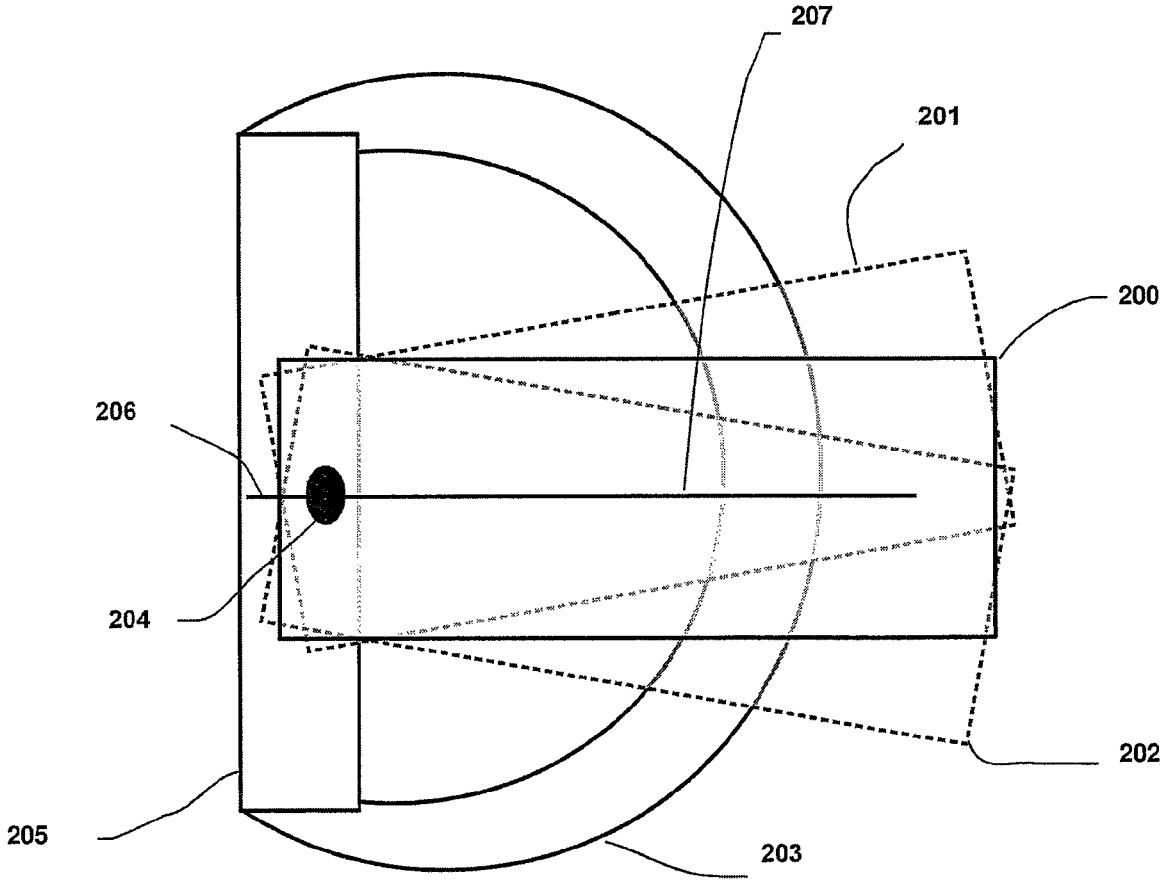
FIG. 2 is a top view of golf club putter head embodiment with movable club face.

With reference to FIG. 2, golf putter head assembly 203 is shown with adjustable golf club head face 205. The club head face 205 can tilt around pivot point 204. As illustrated, a square facing block at position 200 will not require the club head face 205 to pivot relative to the block to hit the ball square. In contrast if the golfer has rotated the grip of the golf club (putter) then the present embodiment would engage a motor to shift the square facing block to position 201. The effect of this shift is to counter the rotational misalignment in the golfers swing by moving the block angularly on the arc shaped track. The square facing block is pivotably movable with respect to club head face 205. When the block is adjusted in angular position, the golf club head face is repositioned such that is returns to square relative to the golf ball. In position 201 golf club head is closed and in position 202 golf club head is open prior to angular adjustment by a motor that provides an angular adjustment of golf club head face 205. Aligning marker 207 is used as reference by golfer for initial alignment setup by establishing it as the desired path and impact location with center of golf ball. The golfer will stand, feet apart, with aligning marker 207 lining up with the ball direction. The club, as explained below, will register a starting point with the club not in motion and the golf club head face 205 square to the golf ball. The club will then return the golf club head face to this position during the swing at the point of impact with the golf ball. This will aid in making sure that the golf club head face is square with the ball and does not hook or slice.

Figure 3:
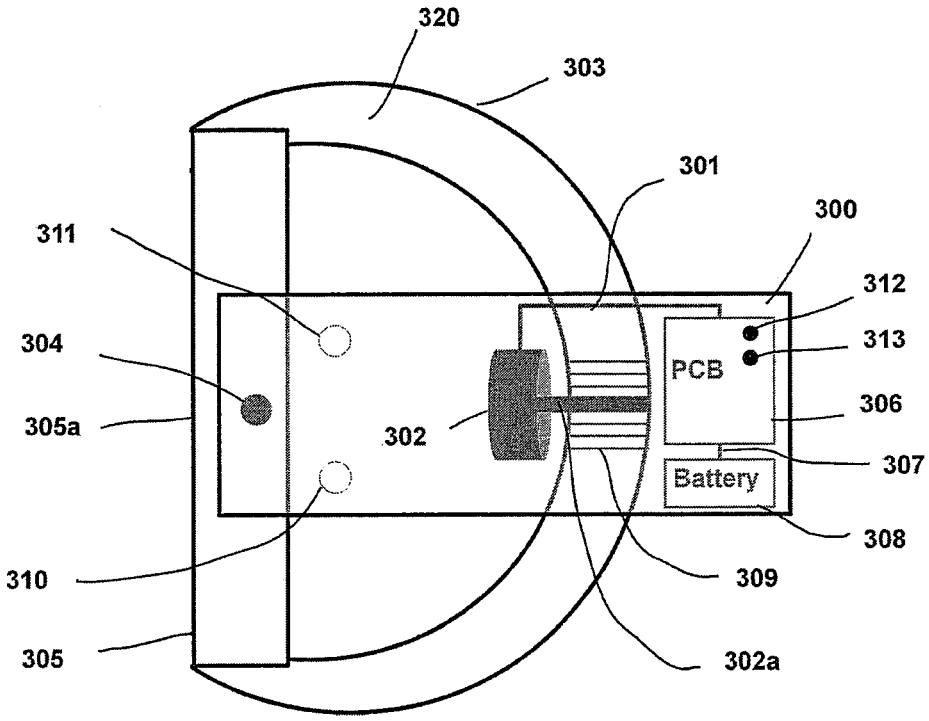
FIG. 3 is a top view of as in FIG. 2, with internal components illustrated.

With reference to FIG. 3 shows an embodiment of the with golf putter head assembly 303, having a moveable golf club face 305 may be attached to a golf club shaft (not shown) using a hosel and ferrule at 310 or at 311 for a left-handed golfer. As shown, the golf club head face 305 can pivot at 304. This embodiment includes LED lights 312 and 313 providing indicator lights to the golfer and extending to the exterior of member 300. Enclosed inside member 300 are electronic sensing and control Printed Circuit Board, PCB 306, powered by rechargeable battery 308 connected to PCB 306 using wires 307. PCB 306 serves as the control process, sending a signal to activate motor 302. Motor 302 turns shaft 302*a* that engage slotted groves 309. Member 300 is pivotably attached to club face 305 at pivot 304, but is otherwise free to pivot as the teeth of shaft 302*a* engage slotted grooves 309 on arch 320. The ball will strike club face 305 at 305*a*. The described embodiment can sense and control the movement of golf club putter and change angle of the golf club head 305.

Figure 4:
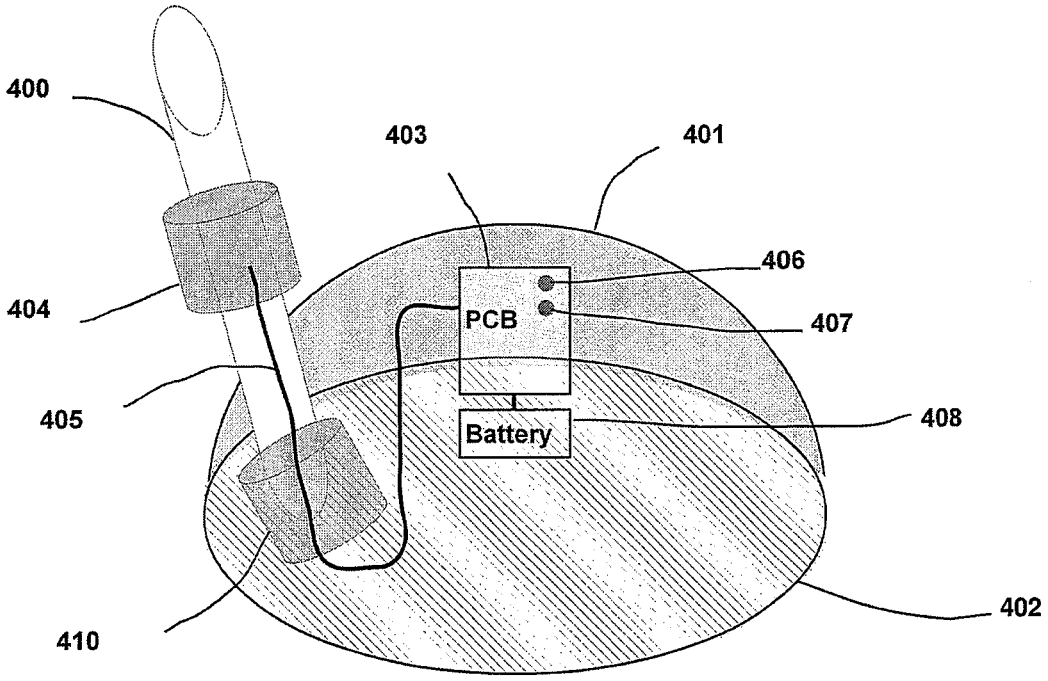
FIG. 4 is a side perspective of a club head and cutaway section of a club shaft showing an embodiment of a golf club driver head that is positionable along to axes (vertical and horizontal axis).

FIG. 4 shows a component make up of an embodiment, with golf driver 401 with moveable golf club head 402 in both vertical and horizontal direction. The moveable golf club head 402, attached to golf club shaft 400 (a left hander golfer would require a mirrored version). Visible are also two LED lights 406 and 407 which are mounted on circuit board 403 contained within head 402 and extending to the exterior of head 402 such that the LEDs 406, 407 are visible to the golfer using driver 401. Enclosed inside golf club 401 are electronic sensing and control Printed Circuit Board, PCB 403, powered by rechargeable battery 408 connected to 403 using wire. Control module 403 drives a motor actuator 404 and 410 that are connected to club shaft 400 such that movement of club head 402 is permitted in both vertical and horizontal directions. Control module 403 also connects to motor actuator 404 and 410 using wire 405. Wire 405 also connects to golf club handle where a pressure sensor can be placed for sensing grip pressure. The described system can sense and control the movement of golf club driver example and change golf club head 402 angle in both vertical and horizontal direction. People familiar in art can also envision how such a dual actuator design can be implemented for golf club putter or any other golf clubs such as irons.

Figure 5:
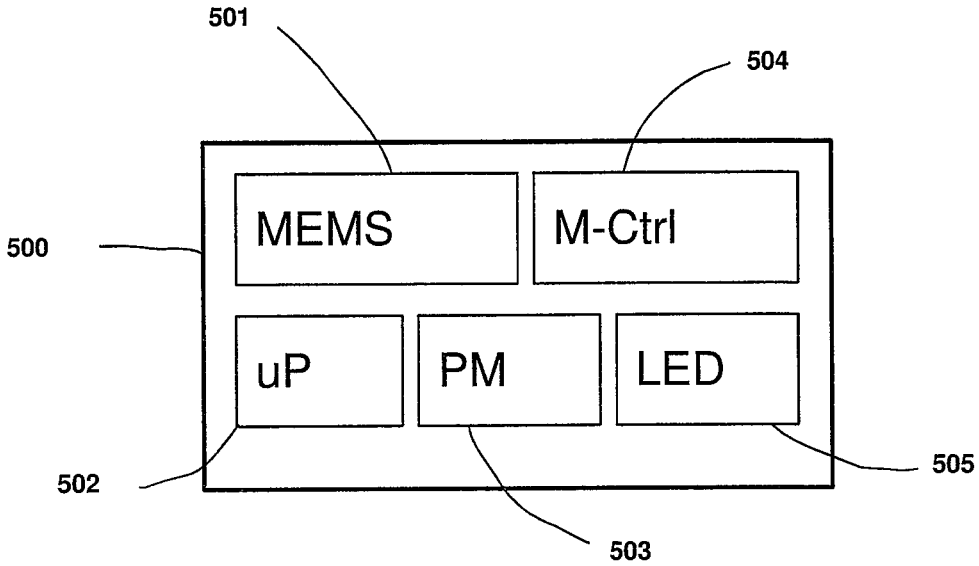
FIG. 5 is a block diagram of components of proposed system including a multi-dimensional (3 or 9 axis MEMS) accelerometers, Motor Controller module (M-Ctrl), Embedded low power processor (uP), Power Management module, LED and switches.

FIG. 5 illustrates a block diagram of electronic components that are integrated into the golf club head with a position adjustable face. MEMS 501 are multi-dimensional accelerometers, gyroscopes and compass systems often referred to as 9-axis or 3-D motion sensor. This component is increasingly available as a low cost component that precisely senses movement, allowing recording of club head speed, direction, and coordinates. Manufacture of such sensors provide software development kits (SDK) that provide full algorithms for calculating location of sensor in X,Y,X coordinate, and reference to location of magnetic compass. This information is processed by microprocessor 502 and various calculations performed such as speed, time, club path, anticipated time of contact with golf ball and other operation critical to control the moveable club head. Furthermore, uP memory unit 502 is capable of storing the generated data for subsequent or simultaneous transmission (wired or wirelessly) to a mobile computing device or personal computing devices, such as a lap top computer or smart cell phone. uP unit 502 is also capable of storing golfer profile information about past swings to better analyze best correction of golf club head, referred to as Artificial Intelligence (AI). At correct time during the golf swing unit 502 will send correction instruction to Motor Controller unit 504 for manipulating the golf club head. uP memory 502 unit may also incorporate a Global Position System (GPS) for sensing location providing the exact location of golf club at time of swing. This information can be stored and later processed for training and analysis. There is also onboard power management module PM, 503 that provide necessary power conversion to electronic and motor driver unit 302. Unit 503 provides recharging circuit for the battery. As example, the golf club battery may be recharged by plugging unit into a computer USB outlet or to AC wall-unit using an AC-to-DC adapter unit. There is also visible LED 505 or other visible indicators that provide feedback to golfer as to status of unit, calibration or other functions. There is also sliding switches as part of LED 505 that allow for electronic unit to be turned ON or OFF, put into calibration or transmission modes or other special functions. All such changes are detected by uP unit 502 and processed accordingly.

Figure 6:
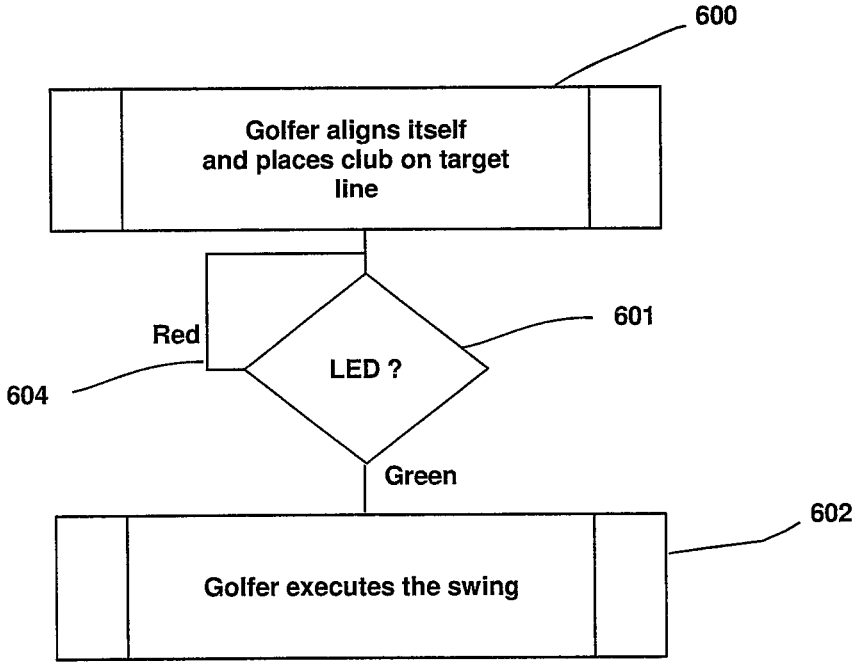
FIG. 6 is an instruction flow chart example.

FIG. 6 illustrate example of how golfer will operate the auto-aligning golf club unit. The golfer will turn the unit ON, align his or her body in parallel to direction of intended golf ball path 100 and 101 (as seen in FIG. 1), and place the golf club faces squarely next to golf ball 105 as normally expected for proper alignment of golfer with intended target, as indicated by block 600. Golfer then observes that visible LED light is Green 601. This indicates to golfer that club head electronic is ready. Golfer may then execute the golf swing 602 and the system will correct for errors caused by golfer. Red 604 means that club head is still moving as golfer needs to align correctly behind the ball first, pause in this position and wait for the green light to indicate that the golf ball impact point has been registered. This pause action will cause the controller to activate green light to signal to golfer that controller has recorded that club head alignment location and golfer can execute the swing.

Figure 7:
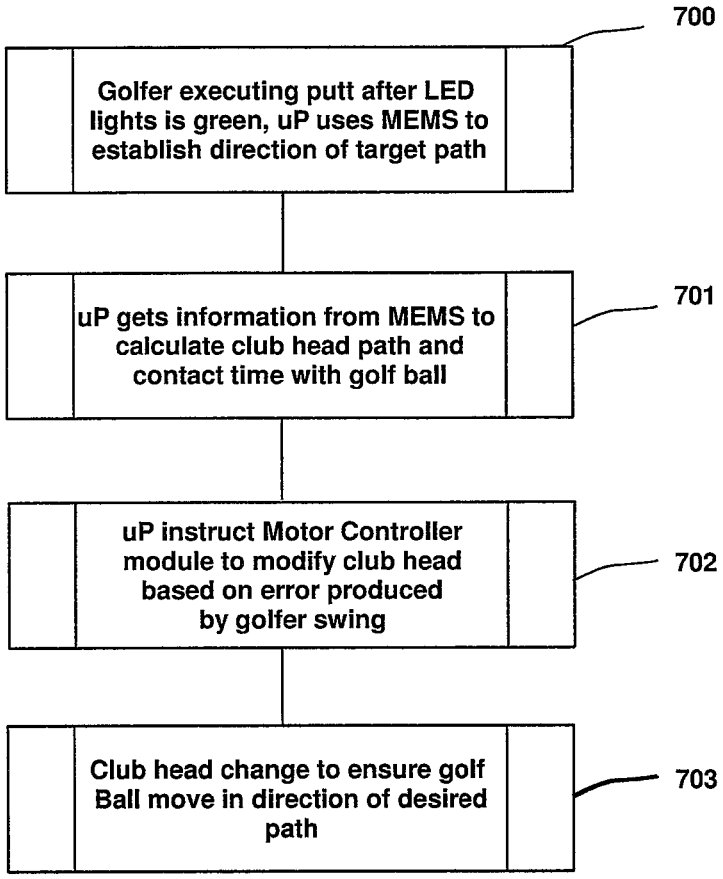
FIG. 7 is flow chart example of system function.

FIG. 7 illustrates example of instructions code inside uP unit 502. As described in FIG. 6 above, once golfer aligns and is ready for golf swing execution 600, uP unit 502 will use information provided by MEMS unit 501 to compute and store direction of intended target 700. As golfer begins the golf swing, uP unit 502 will continuously track information provided from MEMS, optional GPS sensor and grip pressure sensor build into club shaft handle 400 and after applying Digital Signal Processing (DSP) Algorithm to compute and estimate contact time with golf ball 701. If uP unit 502 DSP and Artificial Intelligence algorithms determine that club head correction is necessary then instruction is issued to Motor Controller 504 to modify club head appropriately 702. M-Ctrl unit 504 will apply correct power to motor-actuator unit 302 at correct time interval at prior and after club head makes contact with golf club to ensure the golf ball 100 moves in direction of desired path 703.

Figure 8:
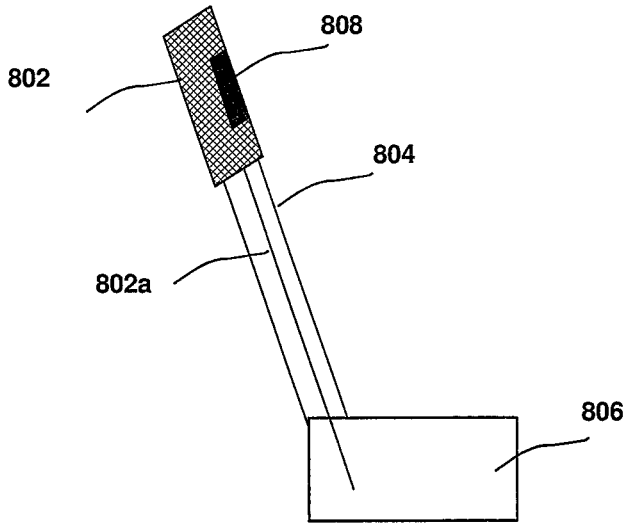
FIG. 8 is a side view of a golf club embodiment.

With reference to FIG. 8, a golf club is shown having a club shaft 804 having a grip 802 at the upper grip end of the club. At the lower club head mount end a club head 806 is mounted on the shaft 804. Within grip 802 is a pressure sensor 808 connected by a wire 802*a* to the controller in club head 806. This allows sensing of the grip pressure during use of the golf club.

What is claimed is:

1. A golf club comprising:

a club shaft having an upper grip end and a lower club head mount end;

a club head mounted on said lower club head mount end, said club head including:

a club face;

at least one motor mechanically linked to said club face and configured to allow a pivotable positioning of said club face;

a controller linked to said at least one motor and configured to actuate said at least one motor during club head movement to alter the position of said club face; and a battery mount joined to said controller and said at least one motor such that when a battery is inserted into said battery mount power may be provided to said controller and said at least one motor.

2. The golf club of claim 1, wherein said club head includes a first motor and a second motor, wherein said first motor is mounted such that said club face can be positionally adjusted vertically and said second motor is mounted such that said club face can be independently positionally adjusted horizontally.

3. The golf club of claim 1, further including a position sensor in said club head, said position sensor linked to said controller and providing data to said controller to control movement of said club face.

4. The golf club of claim 3, further including a data export module joined to said controller and configured to allow data from one or more club swings to be exported to a separate electronic device.

5. The golf club of claim 3, further including a memory in said club head configured to store positional data generated by said position sensor.

6. The golf club of claim 1, further including a grip pressure sensor positioned at said upper grip end of said club shaft, said pressure grip sensor electronically linked to said controller.

7. The golf club of claim 1, further including a visible indicator on said club head and configured to be controlled by said controller to provide visible indication of a controller state.

* * * * *